US009027171B2

(12) United States Patent
Lagobi

(10) Patent No.: US 9,027,171 B2
(45) Date of Patent: May 12, 2015

(54) TRAP AND DRAIN ASSEMBLY FOR DRAINING WASTE LIQUIDS WHILE BLOCKING ODORS

(76) Inventor: Karim Lagobi, Burbank, CA (US)

( * ) Notice: Subject to any disclaimer, the term of this patent is extended or adjusted under 35 U.S.C. 154(b) by 231 days.

(21) Appl. No.: 13/697,007

(22) PCT Filed: May 16, 2011

(86) PCT No.: PCT/US2011/036703

§ 371 (c)(1),
(2), (4) Date: Nov. 8, 2012

(87) PCT Pub. No.: WO2011/143671

PCT Pub. Date: Nov. 17, 2011

(65) Prior Publication Data

US 2013/0205483 A1 Aug. 15, 2013

Related U.S. Application Data

(60) Provisional application No. 61/334,794, filed on May 14, 2010.

(51) Int. Cl.

| | |
|---|---|
| ***A47K 11/00*** | (2006.01) |
| ***A47K 11/03*** | (2006.01) |
| ***E03D 11/02*** | (2006.01) |
| ***E03D 11/18*** | (2006.01) |
| ***F16K 13/00*** | (2006.01) |
| ***E03D 13/00*** | (2006.01) |
| ***E03C 1/28*** | (2006.01) |
| ***E03C 1/29*** | (2006.01) |

(52) U.S. Cl.
CPC ..... *E03D 13/007* (2013.01); *E03C 1/281* (2013.01); *E03C 1/29* (2013.01)

(58) Field of Classification Search
USPC ..... 4/427, 144.1, 317, 459; 137/247
See application file for complete search history.

(56) References Cited

U.S. PATENT DOCUMENTS

| | | | | |
|---|---|---|---|---|
| 4,028,747 | A * | 6/1977 | Newton | 4/317 |
| 5,909,968 | A * | 6/1999 | Olin et al. | 4/431 |
| 5,946,747 | A * | 9/1999 | Geeham | 4/684 |
| 6,886,588 | B2 * | 5/2005 | Malenfant et al. | 137/399 |
| 2010/0205725 | A1 * | 8/2010 | Mcalpine | 4/144.1 |

* cited by examiner

*Primary Examiner* — Huyen Le
*Assistant Examiner* — Christine Skubinna
(74) *Attorney, Agent, or Firm* — Karim Lagobi

(57) ABSTRACT

The invention provides a flush free drain trap system. The trap of the invention may be used in any trap system intended to block a back flow of odors from the waste line. A sealant liquid floats on top of the waste liquid in the trap to block odors. The trap uses one passageway to pass liquids to the sewer line, similarly to a conventional drain system, for preventing overflow and allowing cleaning. A second passageway allows the trap to dispose of small amounts of the waste liquid though an opening and a valve operated by the buoyancy caused by the accumulation of waste liquid in the trap. In normal use, waste liquid is passed to the sewer line without loss of sealant liquid. Furthermore, the performance of the trap is not affected by the evaporation of the waste liquid when the trap is unused.

9 Claims, 3 Drawing Sheets

TRAP AND DRAIN ASSEMBLY FOR DRAINING WASTE LIQUIDS WHILE BLOCKING ODORS

CROSS-REFERENCES TO RELATED APPLICATIONS

The present application is a US national phase entry of International Application number PCT/US11/36703, filed on May 16, 2011, which claims priority to US provisional patent application number 61/334,794, filed on May 14, 2010. The content of each of the latter-referenced applications is incorporated herein in its entirety by reference.

FIELD OF THE INVENTION

The invention relates to a plumbing trap system for passing waste liquids into a sewer pipe while preventing odors from escaping into the surrounding air, more specifically the invention provides a trap that uses a dual passage of waste liquids: a free (unobstructed) passage and a controlled passage of waste liquids.

BACKGROUND OF THE INVENTION

The demand for freshwater is on a constant rise, and consequently, so is the awareness to conserve fresh water. One of the ways to conserve freshwater is to use water drain systems that do not require flush with water. Using water free urinals is a good example of a water saving solution. The idea of water free drains has been contemplated by many inventors. The basic problems flush free urinals have to solve is passing urine to the sewer pipes without leaving an exposed we area where microbes can develop, while preventing urine odors from escaping into the air of the living spaces, and complying with plumbing regulations that demand that the flow of liquids through a trap may not be obstructed (or made potentially vulnerable to obstruction).

In order to address these problems, existing flush free urinals utilize a variation of a U-shaped trap that collects urine in a compartment while minimizing the contact between the collected urine and the surrounding air. Whereas, other types of urinals additionally use a sealant liquid, that is typically an oily substance that floats over the urine in a drain trap and prevents passing of odors from the urine into the air in the inhabitable spaces, see for instance Atwill (U.S. Pat. No. 6,589,440 B2) and Gorges (U.S. Pat. No. 6,053,197).

The liquid sealant approach is more efficient at blocking odors from escaping into the surrounding air. However, the sealant liquid partially mixes with urine at each use, and a portion of it passes to the sewer pipe with each use. Furthermore, if the urinal is infrequently used, the urine evaporates in between uses, allowing a portion of the sealant liquid to pass from the inlet side of the trap to the outlet side of the trap, and on the next use a more substantial portion of the sealant liquid is lost. Therefore, if the urinal is not frequently used, is requires more frequent replenishment of the sealant liquid, thus raising the burden and cost of maintenance.

Furthermore, in order to minimize the loss of liquid sealant in existing water free traps, the turbulence caused by incoming urine into the urinal has to be minimized. Thus, the flow rate through existing traps is kept at a minimum. The latter bring another drawback to existing water free urinals, which is the accumulation of solid waste in the trap, also leading to a necessity for frequent maintenance.

Due to the above drawbacks, despite the potential for significant water saving, current flush free urinals have not been widely adopted. The reason for the lack of widespread adoption may be attributed to a lack of performance for some types of flush free urinals, and/or the relatively high maintenance cost for other types of urinals. For example some flush free urinals do not reduce the smell of urine to a comfortable level. On the other hand, existing urinals that utilize a liquid sealant require a relatively frequent maintenance schedule. The sealant liquid is lost due to normal use and must be replenished after a certain number of uses. Additionally, the least the urinal is used the higher the loss of liquid sealant per use, and the more often the liquid sealant has to be replenished.

Gorges (U.S. Pat. No. 6,973,939) describes a cartridge type for hosting the sealant liquid, and working as a trap. The latter approach allows for an easy replacement of the cartridge. However, given the draw backs of the sealant liquid discussed above, the cost of frequent replacement of a cartridge is also prohibitive to the point of exceeding the cost of using water to flush the urinal. Because of the maintenance cost, liquid sealant based type urinals is mostly beneficial in places with very high frequency of use.

Therefore, there is a need for an economical system for disposing of waste liquids without requiring flushing, while keeping a odor sealant in the trap when the urinal is not used, or infrequently used, and can be easily maintained.

SUMMARY OF THE INVENTION

The invention provides a drain trap system that does not require flushing for draining a waste liquid. The drain trap system is for use in urinals, sinks, floor drains and any other type of drain that intended to block a back flow of odors from the waste liquid. The invention uses a sealant liquid in the trap. The sealant liquid is selected for being non-miscible (and non-dissolvable) in the waste liquid and for having a density lower than that of the waste liquid. Thus, when the sealant liquid is mixed together with the waste liquid the former separates and floats on top of the latter, resulting in the sealant liquid forming a barrier against odors to pass from the waste liquid into the air.

The drain trap, in accordance with the invention, uses two passageways: the first passageway is similar to any existing trap. The latter passageway is based on a U-shaped trap that allows free flow of liquid from an inlet side to an outlet side, thus allowing substantial flow, which prevents overflow. The U-shaped trap also keeps a residual amount of liquid that remains stagnant in the drain to function as a plug (or barrier) for preventing a back flow of odors from the sewers back into the living spaces.

The second passageway connects the bottom of the trap with the sewer using a tubing (or a pipe). The tubing (or pipe) is connected to a release opening at the bottom of the trap. The release opening is controlled by a valve. The valve itself is controlled by a floating mechanism. When there is an inflow of waste liquid, the level of liquids in the trap rises, causing the floating mechanism to act on the valve and open it. The liquid closest to the bottom of the trap (i.e., the liquid having the higher density), then, flows through the release opening via the tubing toward the sewer line, causing in return the level of liquid in the trap to drop, and the floating mechanism to go down to a level where the valve returns to a closed position. A key feature in the design of any embodiment of the invention is to allow a residual quantity of waste liquid and an amount of sealant liquid to keep an odor barrier in place when the drain is not being used. Therefore, by allowing a waste liquid to pass through the liquid barrier, then flow through the release opening toward the sewer, it is possible to minimize the loss of the sealant liquid. The remaining sealant liquid in the trap serves as a barrier to prevent air contact between the residual quantity of waste liquid that also remains in the trap and the ambient air, both preventing odor back flow and reducing evaporation of the remaining waste water. The latter is important in the case of infrequently used urinals, for example, which minimizes the loss of sealant liquid.

Thus, the invention provides a drain trap system that is in compliance with sanitation codes and regulations, since it allows a free flow passageway through the drain. The trap minimizes the loss of sealant during heavy use, and requires less maintenance when infrequently used. Furthermore, when a trap embodying the invention is used in a urinal, because of the novel way the waste liquid is drained toward the sewer line without being sensitive to liquid turbulence in the trap, the urinal bowl may be designed with steep sides so as to speed up the travel of urine along the walls of the bowl, thus minimizing the time urine is in contact with the surrounding air.

DETAILED DESCRIPTION OF THE INVENTION

Figures 1A, 1B:
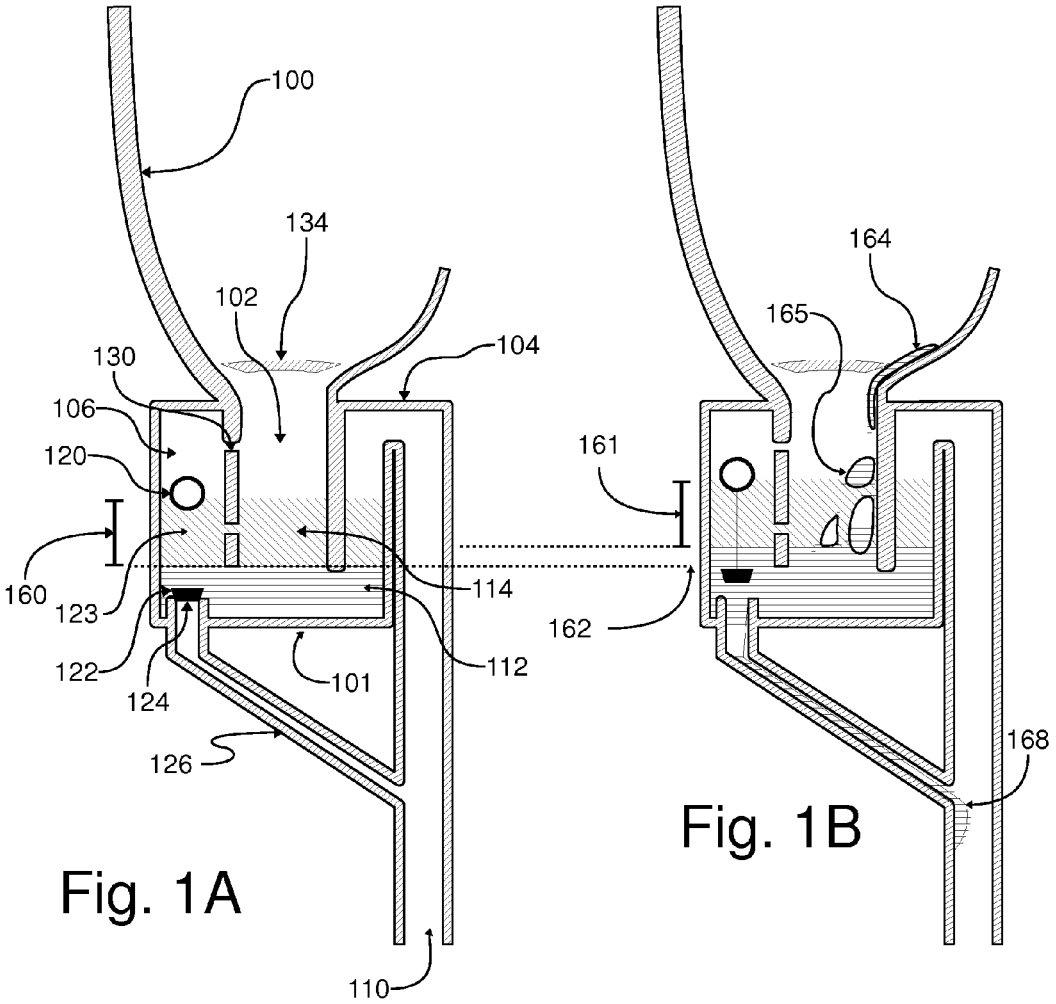
FIG. 1A is a sectional side view schematically representing a trap and drain assembly in accordance with embodiments of the invention.
FIG. 1B is in comparison with FIG. 1A and schematically illustrates the operation of a trap assembly in accordance with an embodiment of the invention.

The invention provides a plumbing trap assembly for draining a waste liquid while blocking odors from escaping into the breathable air (e.g., around persons in living spaces) without necessitating the use of water to flush the drain after each flow of the waste liquid.

In the following description, numerous specific details are set forth to provide a more thorough description of the invention. It will be apparent, however, to one skilled in the pertinent art, that the invention may be practiced without these specific details. In other instances, well known features have not been described in detail so as not to obscure the invention. The claims following this description are what define the metes and bounds of the invention.

Terminology

Throughout the disclosure the terms "trap", "drain trap" and "drain" refers to a plumbing odor trap as describe in the prior art, such as S-trap, P-Trap, Q-trap, bottle-trap or any other trap used to prevent air contact between the sewer and living spaces. It will be apparent to one with ordinary skills in the pertinent art that the invention may practiced with any available trap designs and adapted for any specific application embodying the invention as disclosed herein. The disclosure uses U-shaped trap terminology to refer to any trap (including the above-mentioned types of traps) that uses gravity in order to keep a residual amount of liquid in a trap, and allow free flow from the inlet side to the outlet side (i.e. sewer) of the trap.

The air (or breathable air) is used to refer to the space where odors or any other chemical is undesired.

Description of the Basic Concept

An embodiment of the invention is a plumbing odor trap assembly that may be attached to the bottom of a liquid receiver, such the bowl of a urinal, for passing the waste liquid to a sewer line. The trap is initially filled with a sealant liquid. The sealant liquid is selected to be non-miscible in the waste liquid, and its specific density is lower than that of the waste liquid. For example, for implementations in a urinal apparatus, a sealant liquid may be a hydrophobic liquid having a lower specific density than that of urine allowing the sealant liquid to settle and float on the top of the urine in a mixture of sealant and urine. The trap assembly, in accordance with the invention, provides two (2) passageways for liquids: the first passageway works similarly to a conventional trap, allowing passage of any liquid without obstruction, thus preventing overflow, while retaining a residual amount of liquid to act as an odor trap and prevent odors from diffusing from the sewers into breathable air. The second passageway, in accordance with the invention, comprises a release opening near the bottom of the trap connected with a tubing to the sewer line. A valve (or a similar occluding element) is used to close the opening at the bottom of the trap. The valve is combined with a floating mechanism. The floating mechanism is placed within the trap and is able to float within the liquids inside the trap. The valve and the floating mechanism are designed such that an upward movement (or an up position) under the influence of buoyancy causes the valve to open (or stay open), and vice versa, a downward movement (or down position), for lack of sufficient buoyancy, puts the valve in a closed position. Thus, When the amount of liquids in the trap is below a predetermined level, the valve remains in a closed position. When the drain receives waste water through the inlet of the drain, the waste water flows toward the bottom of the trap, in accordance with the specific densities of the separate liquids described above, and the total level of liquids rises, thus providing the buoyancy for the floating mechanism that automatically causes the valve to open. Since the waste water is located at the bottom of the trap, near the bottom opening, it flows through the opening and via the tubing toward the sewer line. When the level of liquids in the trap falls to (or below) the predetermined level, then the valve closes. The predetermined level of liquid may be designed to keep a portion of the waste water in the trap and all (or at least most) of the sealant liquid in the trap. The remaining sealant liquid in the trap acts as a barrier between the waste liquid and the air.

FIG. 1A is a sectional side view schematically representing a trap and drain assembly in accordance with embodiments of the invention. The trap and drain system 101, in accordance with the invention, may be attached to the main body for receiving waste liquids, such as the bowl of a urinal 100. The trap and drain assembly comprises a main compartment 102 (i.e. an inlet) for receiving waste liquid. The main compartment 102 is connected to the drain pipes 110 through a generally U-shaped (or S-shaped) pipe 104, and allows unobstructed flow of any liquid through the trap. The latter is generally a compliance requirement with the plumbing sanitation and building code. The inlet to the trap and drain may be covered with a cover 134, which allows urine to flow toward the main compartment. The cover 134 may possess some shape design features, the utility of which would be to reduce the velocity of the urine as it enters main compartment 102. Reducing the velocity of the waste liquid as it mixes with the sealant liquid allows for a better separation of the two liquids, thus promoting fast settlement of the waste liquid at the bottom of the trap. The cover 134 may also be tightly fitted so as to allow passing waste liquid while block solid objects the size of which is above a given size, such as cigarette butts, paper waste or any other undesired solid object whose size exceeds a given limit.

At (or close to) the bottom of the trap and drain system, a release opening 124 allows waste liquid to flow through a pipe 126 toward the main drain 110 leading to the sewer line.

The opening is occluded by a valve system. The valve system is combined with a floating mechanism that is under the influence of buoyancy from the liquids. In the absence of sufficient buoyancy, valve 122 closes opening 124. When enough liquid is present in the trap, buoyancy pushes the floating mechanism upward sufficiently to open the valve and allow the waste liquid to flow through opening 124 toward the sewer.

For example, valve 122 may be connected to a floating element 120. A floating element connector 123 connects the valve with the floating element. The length of connector 123 may be designed to be adjustable and its length may be used to determine the amount of liquids that can be retained in the trap.

In other embodiments of the invention, the valve itself my be designed to respond to buoyancy with a weight and density that allows buoyancy to push the valve upward sufficiently to open opening 124.

The valve (and/or floating mechanism) may be hosted in a separate compartment 106, such as shown in FIG. 1A, having one or more holes 130 connecting the compartment 106 with the main compartment 102. The holes allows the pressure to be balanced between compartments 102 and 106 liquids to freely move between compartments.

FIG. 1B is in comparison with FIG. 1A and schematically illustrates the operation of a trap assembly in accordance with an embodiment of the invention. Waste liquid 164 flows from a receiving container 100, into the inlet of a trap embodying the invention. The waste liquid having a higher density than that of the sealant liquid, and being non-miscible with the latter flows toward the bottom (e.g., 165), without any significant mixing. As the waste liquid accumulates in the trap, the level of both liquids rises as indicated by level line 162, while the thickness of the sealant layer, as indicated by 160 and 161, remains constant. The top level of all liquids however rises, providing buoyancy to the floating mechanism (e.g., floating element 120), thus causing the valve to open and release waste liquid from the bottom layer. When sufficient waste liquid (e.g. 168) has been released through opening 124, valve 122 returns to its down position, closing opening 124 and stopping the flow of the waste liquid, and eventually keeping a residual amount of waste liquid in the trap.

Embodiments of the invention prevent loss of sealant liquid from the trap, and allow the thickness of the sealant layer 160 to remain constant while the layer of urine increases and decreases depending on the flow level of waste liquid.

Figure 2:
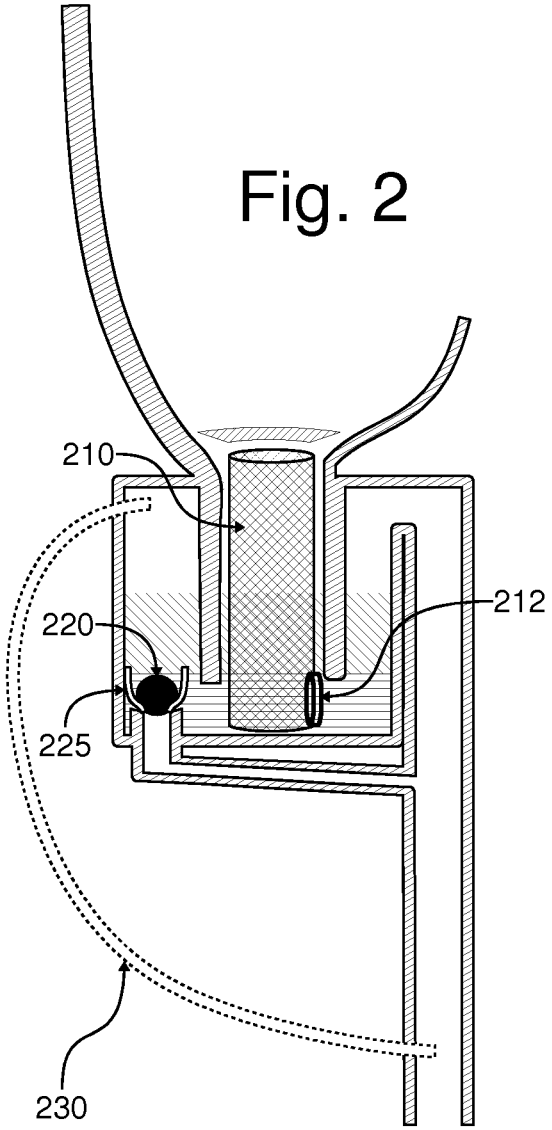
FIG. 2 schematically represent sample features that may be considered when building a device in accordance with an embodiment of the invention.

FIG. 2 schematically represent sample features that may be considered when building a device in accordance with an embodiment of the invention. One or more of the following features may be present either individually or in any combination in a device embodying the invention. FIG. 2 is only a representation of these features. Each feature may be considered separately of in combination when constructing an embodiment of the invention.

Filtering System. In order to allow for maximum efficiency of the trap assembly, a mesh filter may be utilized to filter urine before passing through the valve and opening. A mesh filter 210 may be lowered in the main compartment and may possess a release opening 212 toward the main passageway toward the sewer line allowing for unobstructed passage of liquid towards the main drain. The mesh 212 may be designed for frequent removal and cleaning.

Floating Body and Valve Control. FIG. 2 schematically illustrates how a buoyancy-driven valve 220 may be implemented. A valve may have a ball shape and (e.g., made of rubber) and having a predetermined mass and density such that it is floats when the level of liquid reaches a predetermined level. Otherwise when buoyancy is below a predetermined level, the valve remain in place within a receptacle (e.g., element 225) closing the opening toward the second passageway.

Valve Guiding System. Valve 220 may be guided and kept in place using a rigid guides (e.g., retainers) 225 built around the opening 124.

Pressure Balance. In order to prevent a pressure buildup in any of the compartment in the trap and release system, special tubing (e.g. tubing 230) may be used to connect any of the compartments to the main drain, provided that it does not allow a back flow of air from the sewer line into the air. The pressure balance line allows for balancing pressure and preventing odorous gases from passing into the air of living spaces.

A Flush-Free Urinal

Figure 3:
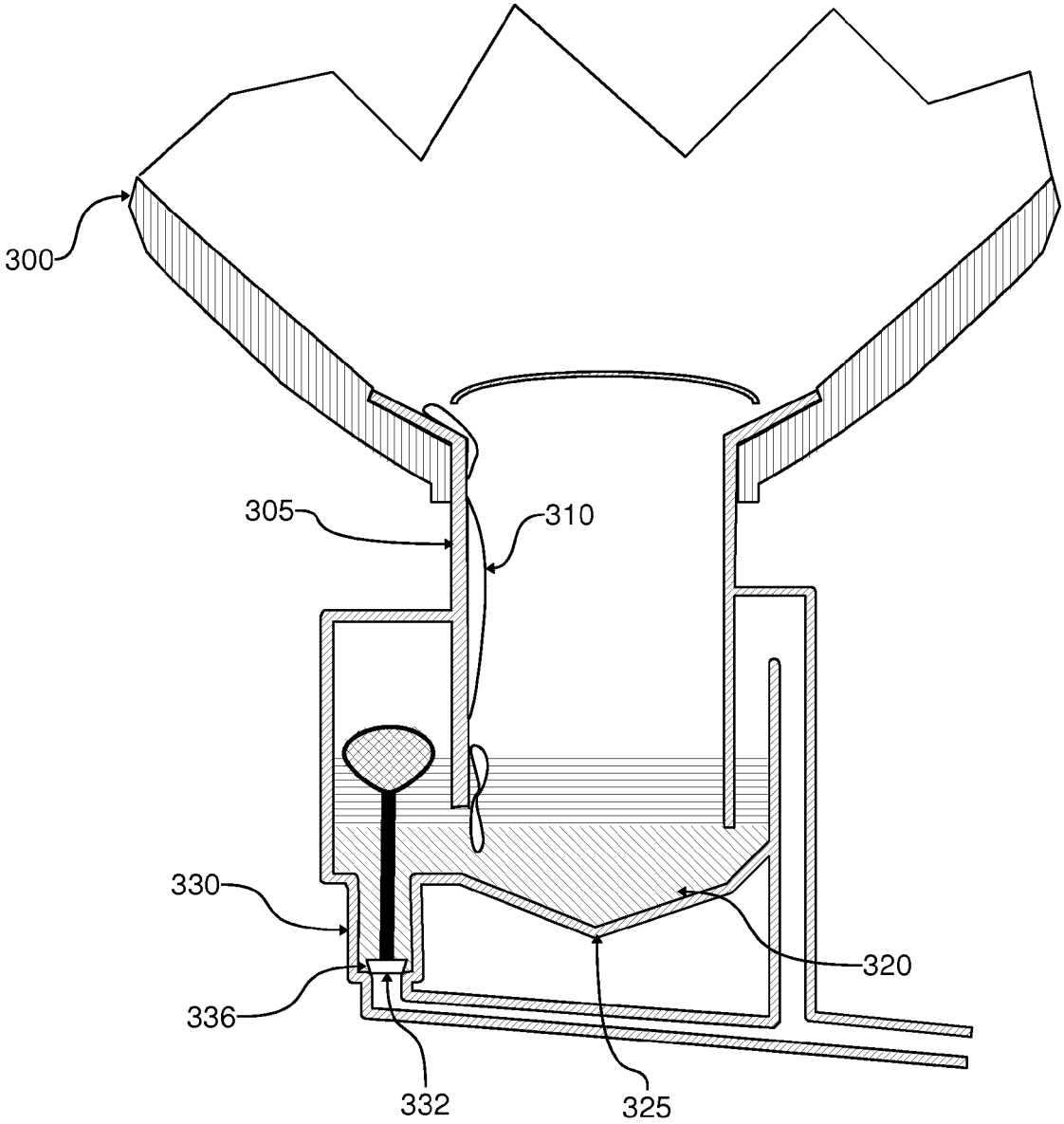
FIG. 3 schematically represents a side view cross section of a urinal built following the teachings of the invention as described above.

FIG. 3 schematically represents a side view cross section of a urinal built following the teachings of the invention as described above. The urinal of FIG. 3 comprises a receptacle 300 for receiving urine. The receptacle in its entirety, or at least the upper surface of the receptacle, may be built using a hydrophobic material, in order to minimize the adhesion of urine droplets to the surface of the receptacle 300.

Because a trap embodying the invention may be designed to prevent loss of sealant liquid due to liquid turbulence, the walls of receptacle 300 may steep, so as to minimize the time the urine 310 is exposed in the air before it flows into the trap 305. As described above, urine flow into the trap and through a layer of sealant liquid. The trap bottom 320 may be shaped such that it collects solid debris, and configured to minimize turbulence as the urine passes through the sealant liquid. For example, the bottom of compartment 320 may be shaped with a depression that dampens the motion of the liquids and allows the urine to quickly separate from the sealant liquid before passing into a second 330 compartment where it may flow through an opening.

The second compartment 330, which may be narrow and deep, may serve to connect to a release opening using a secondary pipe leading to the sewer pipe. The depth and narrowness of compartment 330 allow only the urine, and not the sealant liquid, to reach release opening 332. Valve 336 is designed to close the release opening when the urinal is not in use, and generally when the level of liquids in the trap are below a predetermined level, otherwise, when urine is received in the urinal, as the level of liquids rises and provide enough buoyancy to the floating mechanism, valve 336 is lifted opening the release opening 332, thus causing the accumulated urine to flow out of the trap and toward the sewers. When the level of liquids in the trap returns to a predetermined level, valve 336 automatically closes release opening 332.

Therefore, from the receiving of urine in a flush-free urinal embodying the invention, to the flowing of urine below the sealant layer, to the disposing of the urine into the sewer pipe, there is minimal contact between the urine and the surrounding air. More importantly, the urine is disposed of without requiring flushing with water as it is the case with existing urinal.

Thus, a trap and drain assembly that allows for disposing of waste liquids while preventing a back flow of odorous gases from the sewers without requiring flushing. The concept of trap and drain of the invention, provides a plurality of benefits over the prior art. In the prior art, the loss of the sealant liquid elevated as a result of liquid turbulence, which typically occurs at the receiving and mixing of urine with the sealant liquid. The latter forces the design to a flush-free trap to reduce the speed of the flow of urine into the trap, thus lengthening the time urine is exposed to ambient air. Because an embodiment of the invention prevents (or at least minimizes) the loss of sealant due to turbulence, a urinal in accordance with the invention, allows for designing a urinal receptacle (with steep walls) such that time urine is in contact with the ambient air is minimal. As a result of the latter, there is less undesired smell escaping into the air.

The flush free urinals of the prior art utilize shape features inside the trap in order to retain as much sealant liquid as possible in order to lower the cost of maintenance. These shape features coincidentally also trap solid wastes which renders prior art traps hard (or even impossible) to clean and put back in service. As a result prior art water free traps are designed to be replaced periodically, leading to a high cost of maintenance.

A trap and drain embodying the invention, by using two separate passageways allows for the filtering (potentially through a mesh filter, or simply through decantation) of the waste liquid. Furthermore, when solid waste is trapped in the trap, or as a preventative maintenance measure, the trap of the invention allows a user to flush the trap with sufficient amounts of water, then refill the trap with a sufficient amount of sealant liquid.

Another benefit, overtime if solid deposits (e.g., calcite minerals) accumulate in the trap it is possible to fill the trap with a solution to dissolve the solids, then flush the trap with sufficient amounts of water, and refill the trap with the sealant liquid.

Prior art water free urinals suffer from the fact that if a urinal is infrequently used, the residual urine in the urinal evaporates, leaving the sealant to remain in equal proportions on both the inlet and outlet sides. At the next use of the urinal, the portion of the sealant present on the outlet side of the trap is pushed out of the trap and lost. In short, the least they are used, the more they necessitate replenishment of the sealant liquid. The latter leads to an increased cost of maintenance. Furthermore, because of the latter drawback it is not practical to use the prior urinals in places where, for example, hot weather and/or in remote areas, where the residual urine may evaporate within hours, or maintenance cannot be provided as necessitated by the frequency of use.

A trap built following the teachings of the invention allows a layer of sealant liquid to remain above a residual portion of the urine, thus preventing (or at least significantly slowing down) evaporation of the residual urine. Since the sealant liquid remains in the trap (even if the urine evaporates), the next use of the urinal does not lead to any significant loss of sealant liquid.

The drain trap and release system is in compliance with sanitation codes and regulations. The trap and release system may be installed in the urinal. It is capable of preventing odors from escaping into the air and in living spaces, and does not dry out when the urinal is not frequently used. A device embodying the invention presents numerous advantages compared to prior art. When a urinal according to the invention is not used over long periods of time, the residual urine is kept below a layer of hydrophobic liquid. The latter prevents the urine from evaporating which would otherwise cause all sealant to settle at the bottom and be lost at the next use. It is possible to design the trap such a turbulence, that typically cause urine to mix so when the assailant, can be minimized. Furthermore, because of the physical separation it is also possible to implement a filter that removes solid chunks from the urine as it is gradually drained. The latter characteristics allow one with ordinary skills in the pertinent art to design a trap with removable parts (e.g., bottom of the compartments such 320 and 330) of for easy cleaning and maintenance. For example a filter e.g. 112 may be inserted into the trap in order to filter urine that is gradually drained and capture other solids they may settle to the bottom of the drain. For maintenance purposes, the filter may be removed cleaned and or replaced. Furthermore, the trap and drain system in accordance with the invention may be cleaned using industrial detergents to dissolve deposits, then cleaned with water followed by replenishment of the sealants liquid. The latter is a significant advantage over existing solutions which require replacement of a cartridge.

Thus, a trap assembly for use in a drain to dispose of waste liquid while blocking a back flow of odors from the waste liquid and/or sewer line.

The claimed invention is:

1. A trap assembly for draining waste water toward sewer pipes while blocking back flow of odors comprising:

a U-shaped liquid trap for containing a waste water and a sealant liquid, wherein the specific density of said sealant liquid is lower than the specific density of said waste water, causing said sealant liquid to float above said waste water, and wherein said U-shaped liquid trap having an interior, a receiving opening for receiving said waste water, an outlet pipe for connecting to a sewer line, and a release opening near a bottom of said interior, wherein said interior further comprising a first compartment and a second compartment, wherein said first compartment and said second compartment are connected through at least one relief hole, and wherein said first compartment is connected to said sewer line through said main flow pipe, and wherein said release opening is at the bottom of said second compartment;

a release pipe connecting said release opening to said sewer line;

a valve mounted within said interior in proximity of said release opening, said valve configured to occlude said release opening when the buoyancy from said sealant liquid and said waste water in said interior is below a predetermined level, and wherein said valve is in an open position when the buoyancy of said sealant liquid and said waste water is at least equal to said predetermined level.

2. The trap assembly of claim 1 wherein said valve possesses a density lower than that of said sealant liquid.

3. The trap assembly of claim 1, further comprises a floating element within said interior, said floating element connected with said valve.

4. The trap assembly of claim 1 further comprises a floating mechanism having a floating element suspended in said sealant liquid and said waste water, and connected with said valve through a connector.

5. The trap assembly of claim 4, wherein a length said connector determines a level of said waste water at which said valve switches from a closed position to an open position.

6. A urinal for disposing of urine comprising:

a collection bowl configured to collect urine; and a trap assembly attached to the bottom of said collection bowl to carry said urine from said collection bowl to a sewer line, wherein said trap assembly further comprising:

a housing for containing a sealant liquid and at least a portion of said urine, said housing having an interior, a main flow pipe having a U-shape, and a release opening in proximity of the bottom of said interior, wherein said interior further comprising a first compartment and a second compartment, wherein said first compartment and said second compartment are connected through at least one relief hole, and wherein said first compartment is connected to said sewer line through said main flow pipe, and wherein said release opening is at the bottom of said second compartment;

a release pipe connecting said release opening with said sewer line; and a valve combined with a floating element causing the valve to close said release opening when the volume of said urine is below a predetermined amount, and wherein said valve is in an open position when said volume of said urine is above said predetermined amount.

7. The urinal of claim 6 wherein the surface of said collection bowl is covered with a hydrophobic material.

8. The urinal of claim 7, wherein said collection bowl is entirely made of said hydrophobic material.

9. The urinal of claim 8, further comprising a mesh filter within said interior, said mesh filter at its bottom facing said U-shape main pipe for allow unobstructed passage of a large flow of a wash liquid.

* * * * *